United States Patent [19]

Maier et al.

[11] 4,267,419

[45] May 12, 1981

[54] CIRCUIT BREAKER STRUCTURE WITH SHOCK ABSORBERS

[75] Inventors: Alfred E. Maier, Beaver Falls; Walter V. Bratkowski, McKessport, both of Pa.

[73] Assignee: Westinghouse Electric Corp., Pittsburgh, Pa.

[21] Appl. No.: 62,273

[22] Filed: Jul. 30, 1979

[51] Int. Cl.[3] ..... H01H 3/60

[52] U.S. Cl. ..... 200/288; 335/46; 335/193

[58] Field of Search ..... 335/46, 193; 200/244, 200/288

[56] References Cited

U.S. PATENT DOCUMENTS

| | | | |
|---|---|---|---|
| 2,137,001 | 11/1938 | Healis | 200/288 |
| 2,383,403 | 8/1945 | May et al. | 335/46 |
| 3,267,243 | 8/1966 | DoHo | 200/244 |
| 4,064,383 | 12/1977 | Barkan | 200/288 |
| 4,114,005 | 9/1978 | Maier et al. | 200/288 |

FOREIGN PATENT DOCUMENTS

| | | | |
|---|---|---|---|
| 637641 | 5/1950 | United Kingdom | 200/288 |

*Primary Examiner*—John W. Shepperd
*Attorney, Agent, or Firm*—L. P. Johns

[57] ABSTRACT

A multiphase circuit breaker structure characterized by stationary and movable contact means for each phase, a cross bar operatively connected to the movable contact means, a stop plate for stopping movement of the cross bar during opening of the contacts, and shock absorbing means on one of the stop plate and cross bar for absorbing energy released when the cross bar moves to the open position of the contacts.

2 Claims, 5 Drawing Figures

II
II
7
9
13
15
17
19
25
27
29
31
33
35
37
39
39
41
43
45
45
47
49
51
53
59
63
67
69
71
73

CIRCUIT BREAKER STRUCTURE WITH SHOCK ABSORBERS

BACKGROUND OF THE INVENTION

1. Field of the Invention

This invention relates generally to single or multiple circuit breakers, and, more particularly, to stored energy circuit breakers.

2. Cross Reference to Related Applications

This application is related to the copending application of A. E. Maier and James R. Farley, Ser. No. 077,530, filed Sept. 21, 1979; and of A. E. Maier, L. N. Ricci, and Charles Haugh, Ser. No. 102,047, filed Dec. 10, 1979.

3. Description of the Prior Art

The primary functions of circuit breakers are to provide electrical system protection and coordination whenever abnormalities occur on any part of the system. Operating voltage, continuous current, frequency, short circuit interrupting capability, and time current coordination requirement are some of the factors that must be considered when designing a circuit breaker. Increasing demands are being placed upon the electrical industry for interrupters with improved performance.

Associated with the foregoing are circuit breakers with high ratings that develop very high forces between contacts. This causes the opening contact assembly to develop a very high speed on opening, which in turn causes the moving contact assembly to bounce closed when it strikes a stop and the end of its travel.

SUMMARY OF THE INVENTION

In accordance with this invention, a circuit breaker is provided which comprises stationary contact means including three and four laterally spaced stationary contacts, movable contact means, operable between open and close positions of the stationary contact means and comprising three corresponding movable contacts and contact carrying arms therefor, a circuit breaker operating mechanism releasable to effect opening and closing of the contacts, a cross bar extending between and connected to the arms and to said mechanism, a frame supporting the operating mechanism, shock absorbing means on the frame and comprising a pair of spaced stop plates in the path of movement of the cross bar for absorbing energy released when the cross bar moves to the open position of the contacts, and the shock absorbing means comprising a body of elastic material between the stop plate and cross bar.

The advantage of the circuit breaker structure of this invention is that the shock absorber absorbs energy released from the cross bar and reduces or eliminates the bounce, thereby preventing restrike of the contacts which in turn could cause a failure to interrupt a short circuit fault.

DESCRIPTION OF THE PREFERRED EMBODIMENTS

Figure 1:
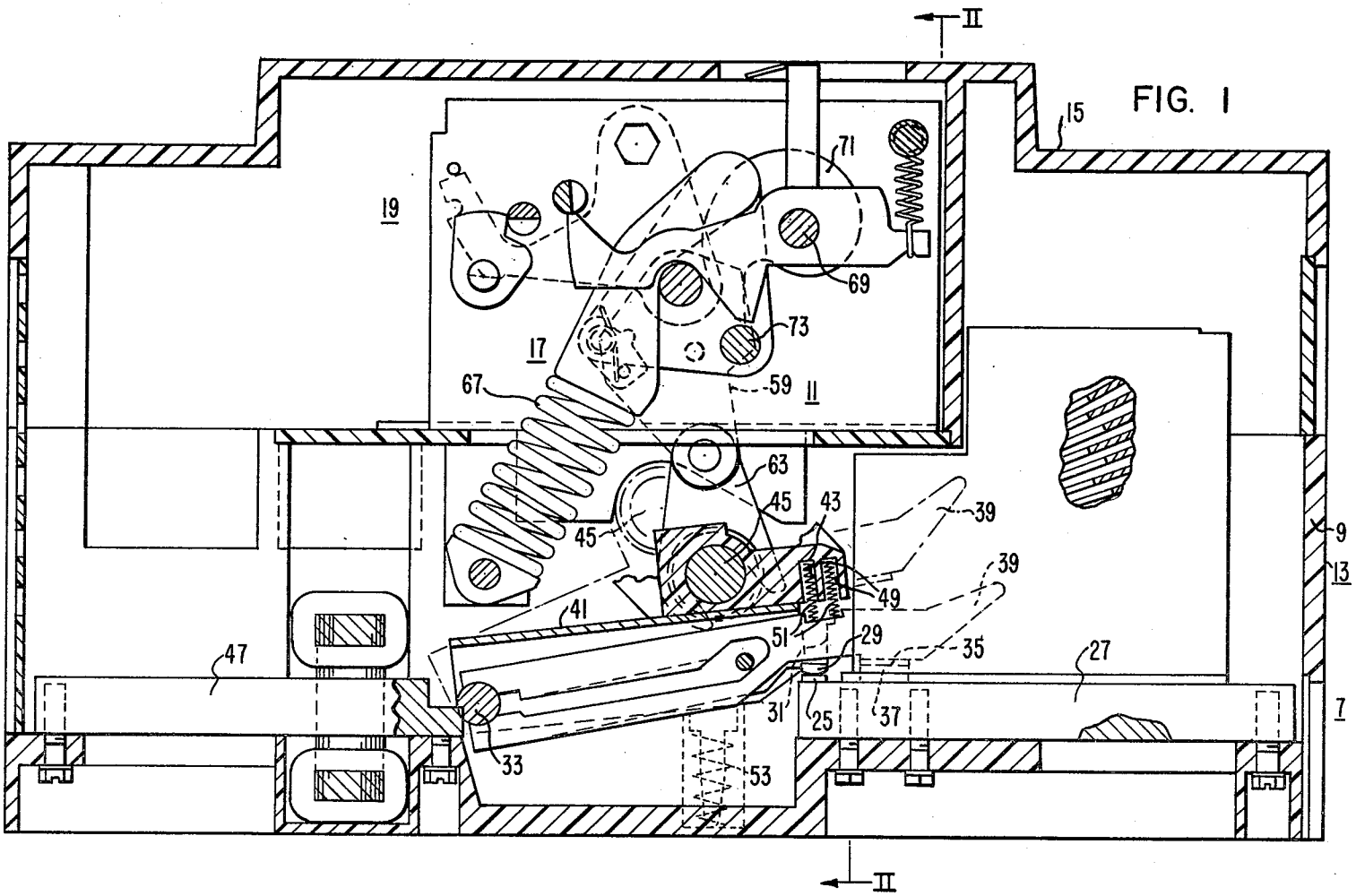
FIG. 1 is a vertical sectional view through a stored energy circuit breaker, taken on the line I—I of FIG. 2.

In FIG. 1, a circuit breaker is generally indicated at 7 and it comprises an insulating housing 9 and a circuit breaker mechanism 11 supported within the housing. The housing 9 comprises an insulating base 13 and an insulating cover 15.

The circuit breaker mechanism 11 comprises an operating mechanism 17, and a latch and trip device 19. Except for the latch and trip device, the circuit 7 is of the type that is generally disclosed in the patent to Alfred E. Maier et al., U.S. Pat. No. 4,114,005, issued Sept. 12, 1978, and is incorporated by reference herein. The circuit breaker 7 is a three-pole circuit interrupter comprising three compartments disposed in side-by-side relationship. The center pole compartment (FIG. 2) is separated from the two outer pole compartments by insulating barrier walls 21, 23 formed with the housing base 13. The circuit breaker mechanism 11 is disposed in the center pole compartment and is a single operating means for the contacts of all three pole units.

Each pole unit comprises a stationary contact 25 (FIG. 1) that is fixedly secured to a main conductor 27. For each pole unit a movable contact 31 is secured, such as by welding or brazing, to a contact arm 31. More particularly, (FIG. 2) a plurality of spaced movable contacts 29 are mounted on laterally spaced contact arms 31 for each pole. Each contact arm 31 is pivotally mounted on a pivot pin 33 which is common for all of the contact arms 31 for each pole. Each pole also comprises one or more moving arcing contact 35 and a stationary arcing contact 37, the former of which is mounted on arcing contact arm or arms 39 which is pivotally mounted on pivot pin 33.

Figure 2:
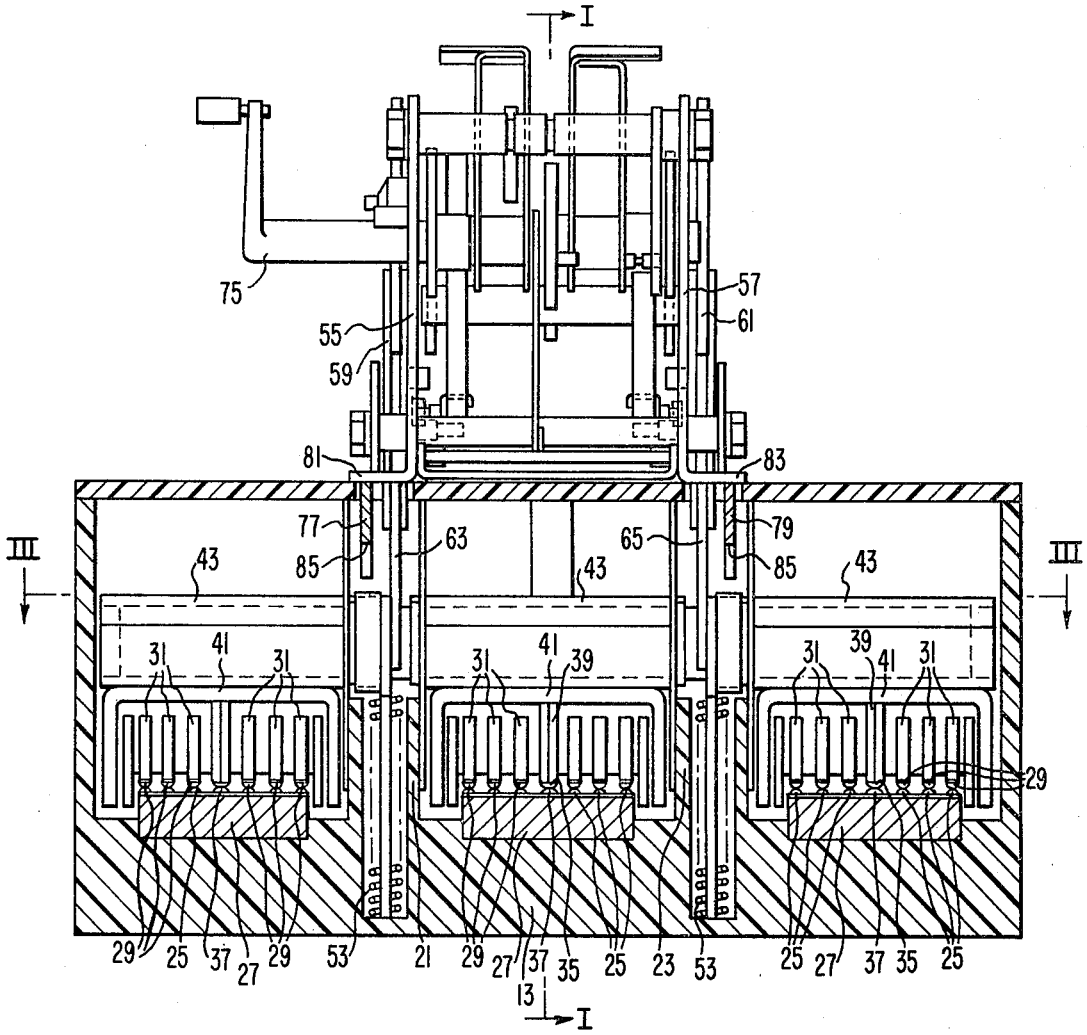
FIG. 2 is a vertical sectional view taken on the line II—II of FIG. 1.

As shown in FIG. 2, each group of contact arms 31 is contained within a support arm 41 which is likewise pivoted on the pivot pin 33. Each arm 41 supports a clamp 43 which is attached to the arm in a suitable manner which is comprised of an electrically insulating material. The clamps 43 have aligned apertures through which a cross bar 45 extends over the three poles of the circuit breaker 7. The cross bar 45 is used to close all three poles by the circuit breaker mechanism 11. Thus, in the open position, the contact arms 35, 39 are in a raised position as indicated by the broken line position of the arm 39, and by the broken line position 45 of the cross bar (FIG. 1). When the contacts are closed, the circuit through the circuit breaker 7 moves from the main conductor 27 and through the contacts 25, 29, the arms 31, the pivot pin 33, and a conductor 47.

Each clamp 43 comprises a pair of two rows of holes 49 with a pair of poles being disposed over each contact arm 31. A coil spring 51 is disposed in each hole and the lower end of each spring presses against the upper side of the contact arm for holding the contacts 25, 29 in tight electrical contact. Moreover, the springs 51 as well as coil springs 53 (FIG. 2) cooperate to bias the cross bar 45 and the movable contacts 29 to the open position.

The operating mechanism 17 actuates the switch arms 41 between the open and close positions. The mechanism is disposed between a pair of spaced support frames 55, 57. The operating mechanism 17 is described in structure and operation in U.S. Pat. No. 4,114,005, for which reason only pertinent portions of the mechanism are explained herein. The mechanism comprises a toggle including a first of spaced apart toggle links 59, 61, and a second pair of spaced apart toggle links 63, 65, and a closing spring assembly 67. The spring assembly 67 is charged with stored energy by a charge structure including a driven shaft 69 and a cam 71 which actuates a cam roller 73, whereby the closing spring assembly 67 is actuated from a discharge to a charged condition for closing the contacts. The driven shaft 69 may be operated either by an electric motor or manually by a crank 75.

In accordance with this invention, the circuit breaker 7 includes means for absorbing energy from the assembly of the contact arms 31, the clamps 43, and the cross bar 45 when the contacts are open. In prior constructions where no shock absorbing means is provided for circuit breakers of the type involved, the energy released for causing the cross bar 45 to move from the closed to the opened positions frequently causes the assembly of the contact arms to bounce and reclose the contacts, as well as to subject the cross bar to high stresses. By providing shock absorbing means, the energy causing reclosing of the contacts and/or high stress on the cross bars is absorbed.

Figure 4:
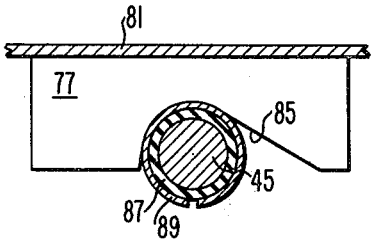
FIG. 4 is a fragmentary sectional view taken on the line IV—IV of FIG. 3.

The shock absorbing means for this invention comprises a pair of spaced apart stop plates 77, 79 which are mounted on the support frame of the circuit breaker 7 in a suitable manner, such as by being fixedly mounted to flanges 81, 83 of the support frames 55, 57 respectively. The plates comprise similar notches 85 for receiving the cross bar 45 from stopping its counterclockwise motion during the opening of the contacts. As shown in FIG. 4, the cross bar 45 includes a ring 87 which is contained within a retaining outer ring 89. The ring 87 is comprised of a flexible material such as rubber. The outer ring 89 is comprised of metal such as steel for protecting the flexible ring 87. Accordingly, when the cross bar 45 hits the stop plates 77, 79, the energy of the moving cross bar is absorbed by the flexible ring 87 and prevents the bus bar from bouncing and possibly returning the contacts to the closed position.

Figure 5:
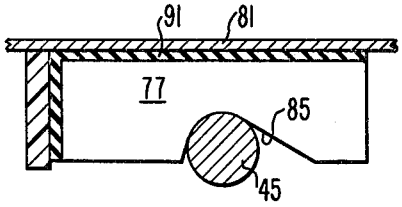
FIG. 5 is a sectional view showing another embodiment of the invention.
Figure 3:
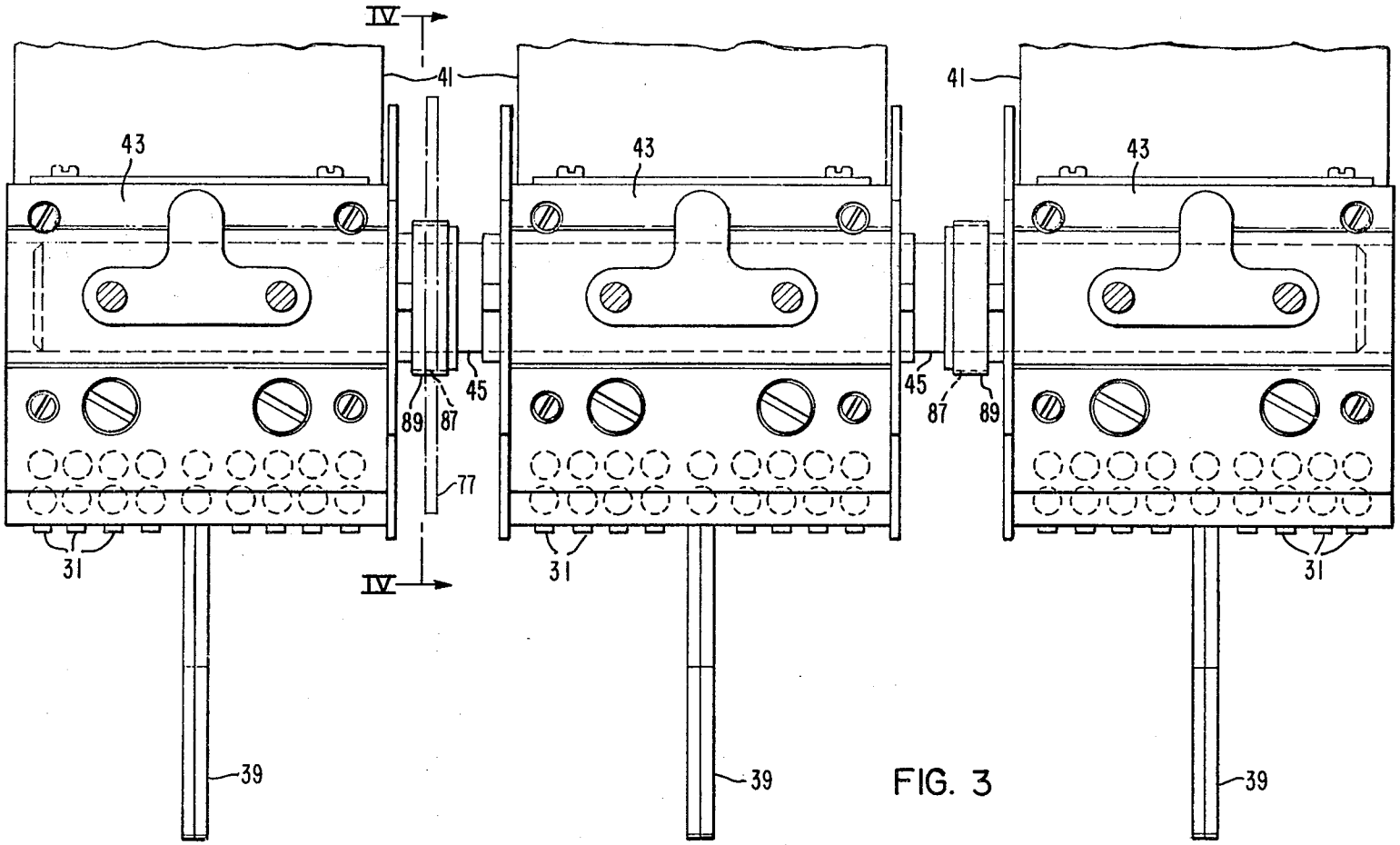
FIG. 3 is a plan view taken on the line III—III of FIG. 2.

Another embodiment of the invention is shown in FIG. 5 in which similar numbers refer to similar parts. A strip 91 of flexible material is disposed between the stop plates 77, 79 and the corresponding flanges 81, 83. The strip 91 serves the purpose of observing the energy of the cross bar 45 for which reason the cross bar 45 (FIG. 5) is devoid of a flexible ring 87 such as provided on the cross bar in FIG. 4. Accordingly, in FIG. 5 when the cross bar 45 strikes the stop plates 77, 79, the energy is absorbed by the strip 91 of flexible material and thereby prevents the bus bar from bouncing out of the notches 85.

In conclusion the shock absorbing devices of this invention absorb energy and reduce the bounce of a cross bar which otherwise develops. As a result, the device prevents restriking of the contacts which could cause failure to interrupt a short circuit fault.

What is claimed is:

1. A circuit breaker comprising:

(a) stationary contact means;

(b) movable contact means operable between open and closed positions of the stationary contact means;

(c) a frame;

(d) contact arm means for supporting the movable contact means and pivotally mounted for movement of the contacts between said positions;

(e) a circuit breaker operating mechanism releasable to effect opening and closing of said contacts;

(f) a cross bar operatively connected between the contact arm means and said mechanism and movable through an arc during opening and closing of the movable contacts;

(g) a stop plate mounted on the frame for stopping movement of the cross bar during opening of the contacts;

(h) shock absorbing means disposed in one of the stop plate and the cross bar for absorbing energy released when the cross bar moves to the open position of the contacts;

(i) said mechanism comprising toggle means including a toggle link connected to the cross bar;

(j) the stationary contact means comprising three laterally-spaced stationary contacts with corresponding movable contacts and contact-carrying arms;

(k) the cross bar extending between and being connected to the arms;

(l) spaced stop plates on the frame at locations between the locations of the stationary contacts; and (m) the shock absorbing means comprises an elastic sleeve on the cross bar.

2. The circuit breaker of claim 1 in which a metal ring encases the elastic sleeve.

* * * * *